United States Patent [19]

Papst et al.

[11] Patent Number: 4,874,037

[45] Date of Patent: Oct. 17, 1989

[54] APPARATUS FOR COOLING A HOT PRODUCT GAS

[75] Inventors: Gero Papst, Kaarst, Fed. Rep. of Germany; Michael Nagl, Linz, Austria

[73] Assignees: Korf Engineering GmbH, Fed. Rep. of Germany; Voest-Alpine Aktiengesellschaft, Austria

[21] Appl. No.: 756,294

[22] Filed: Jul. 18, 1985

[30] Foreign Application Priority Data

Jul. 18, 1984 [DE] Fed. Rep. of Germany ..... 3427088

[51] Int. Cl.[4] ..... F28F 19/00; C10J 3/68; F28D 21/00

[52] U.S. Cl. ..... 165/47; 165/134.1; 34/13; 34/20; 48/77; 48/87; 48/DIG. 2; 48/210; 196/140; 196/133; 422/207

[58] Field of Search ..... 165/47, 134.1; 34/13, 34/20, 233, 237, 238; 202/260; 60/758, 757, 39.55; 48/77, 87, DIG. 2, 210; 208/48 R, 48 Q; 196/140, 133; 422/207, 203, 205

[56] References Cited

U.S. PATENT DOCUMENTS

| | | | |
|---|---|---|---|
| 1,531,475 | 3/1925 | Brandt | 60/39.55 |
| 2,343,866 | 3/1944 | Hincke | 196/133 |
| 2,569,446 | 10/1951 | Bonvillian et al. | 60/757 |
| 2,603,064 | 7/1952 | Williams | 60/758 |
| 2,745,250 | 5/1956 | Johnson et al. | 60/758 |
| 3,024,606 | 3/1962 | Adams et al. | 60/736 |
| 3,256,065 | 6/1966 | Latham, Jr. | 422/203 |
| 3,352,106 | 11/1967 | Pianko | 60/758 |
| 3,416,598 | 12/1968 | Dorn | 165/134.1 |
| 3,899,876 | 8/1975 | Williamson | 60/757 |
| 4,054,424 | 10/1977 | Staudinger et al. | 34/13 |
| 4,097,544 | 6/1978 | Hengstebeck | 165/134.1 |
| 4,157,244 | 6/1979 | Gernhardt et al. | 48/210 |
| 4,172,708 | 10/1979 | Wu et al. | 34/13 |
| 4,211,536 | 7/1980 | Hamilton | 202/269 |
| 4,300,913 | 11/1981 | Egert et al. | 48/DIG. 2 |
| 4,305,732 | 12/1981 | Koenig et al. | 48/67 |
| 4,337,927 | 7/1982 | Megerle | 165/56 |
| 4,362,500 | 12/1982 | Eriksson et al. | 60/757 |
| 4,369,163 | 1/1983 | Schingnitz et al. | 422/205 |
| 4,446,693 | 5/1984 | Pidcock et al. | 60/758 |
| 4,703,793 | 11/1987 | Townsend | 165/134.1 |

FOREIGN PATENT DOCUMENTS

| | | | |
|---|---|---|---|
| 127287 | 1/1902 | Fed. Rep. of Germany | 60/39.55 |
| 2526922 | 1/1976 | Fed. Rep. of Germany . | |
| 3241853 | 5/1984 | Fed. Rep. of Germany | 202/260 |

*Primary Examiner*—John Ford

[57] ABSTRACT

An apparatus for cooling a hot product gas, the latter is passed through a tubular zone. The product gas contains particles which, on entering the tubular zone, are tacky, but lose their tackiness through cooling in said zone. Within said zone a cooling gas flow forms a gas wall, which prevents contact between the product gas or the tacky particles contained therein, and one of the fixed walls in the tubular zone. Thus within an outlet connection (2) forming the tubular zone is provided an anular insert (3), which forms a gap (4) with the outlet connection. A cooling gas is blown into this gap counter to the flow direction of the product gas. At the end of the insert, this cooling gas is deflected by the product gas and flows within the insert in the same direction as the product gas and protects the inner wall of the insert from the latter. This product gas is cooled to such an extent by the action of the cooling gas that the particles in the product gas have lost their tackiness at the outlet-side end of the insert.

9 Claims, 2 Drawing Sheets

APPARATUS FOR COOLING A HOT PRODUCT GAS

BACKGROUND OF THE INVENTION

Field of the Invention

The invention relates to an apparatus for cooling a hot product gas containing tacky particles and which lose their tackiness on cooling, the product gas being passed through a tubular zone, in which it is cooled and simultaneously a gas wall is formed, which prevents contact between the product gas and a fixed wall in the tubular zone.

Description of the Prior Art

Such an apparatus is known from DE-OS 25 26 922. In the case of this apparatus, a particle-free protective gas is fed in in the vicinity of the inlet to the tubular zone in such a way that a protective gas wall is formed on the wall of said zone and prevents contact between the tubular zone wall and the hot product gas and simultaneously a cooling gas is added to the hot product gas in said zone. In order to form a protective gas wall, the protective gas is fed into the tubular zone with a tangentially directed velocity component. The cooling gas is fed in through radially extending inlets which, above the protective gas inlets, are arranged at the same height and in equidistantly spaced manner around the periphery of the tubular zone. It is a disadvantage of this known apparatus that it is only possible to influence the flow of the protective gas in the tubular zone through the outflow direction on entering said zone. Thus, a continuous protective gas wall over the entire length of the tubular zone is not ensured. In addition, the apparatus is relatively complicated, because two different gases must be used for cooling and for forming a protective gas wall.

SUMMARY OF THE INVENTION

The problem of the present invention is therefore to provide an apparatus of the aforementioned type, in which a protective gas wall effective over the entire length of the tubular zone is formed for the purpose of preventing contact between the product gas containing the tacky particles and a solid wall and in which said gas wall has a simple construction.

According to the invention, this problem is solved in that an annular insert extending along at least part of the tubular zone is provided, and which forms a gap between it and the wall of the tubular zone, as well as a passage for the product gas, and that a cooling gas can be blown into the gap between insert and the wall of the tubular zone at the end of insert opposite to the entry of the product gas into tubular zone.

DESCRIPTION OF THE PREFERRED EMBODIMENT

Figure 1:
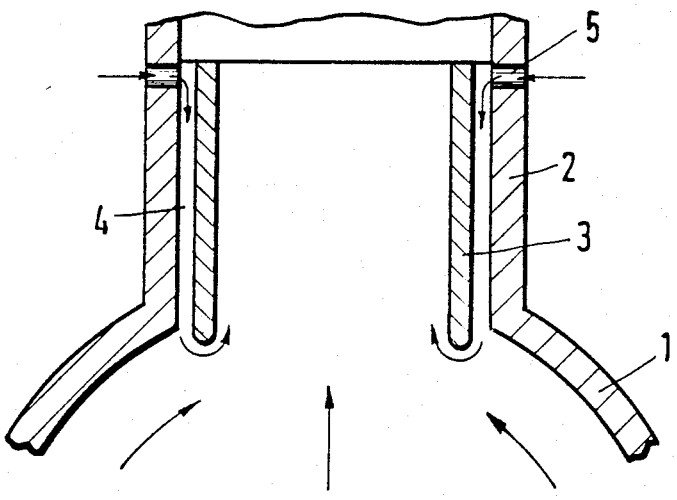
FIG. 1 shows a partially cut away elevation view of a device embodying the present invention.
Figure 2:
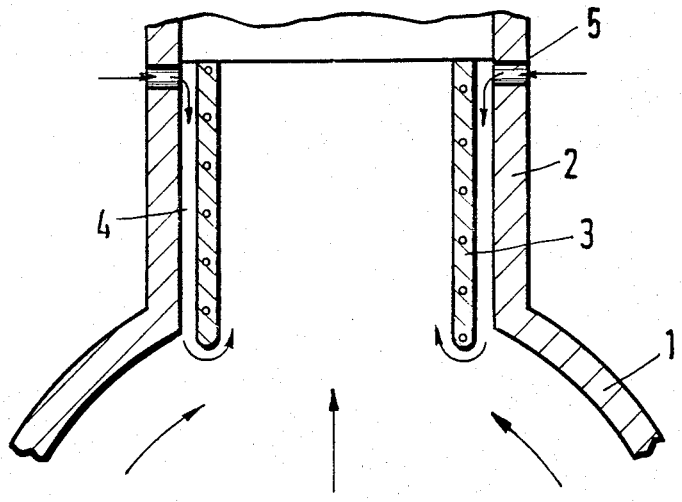
FIG. 2 shows an alternative embodiment of the insert wall used in the device embodying the present invention.

The invention is described in greater detail hereinafter relative to an embodiment shown in the drawing, which shows a wall section 1 of a gasifier, in which the product gas is produced. The wall section 1 passes into an outlet connection 2 forming the tubular zone, through which the product gas flows upwards and out of the gasifier. The product gas entrains particulate substances with it, which, as a result of the high product gas temperature are tacky, and only lose their tackiness after cooling the product gas. However, at the lower part of outlet connection 2, the temperature of the product gas is still so high that there is a risk of the entrained particles sticking to a solid wall if they meet such a wall. As this would lead to a constriction or even the complete closure of the free diameter of the outlet connection 2, it is necessary to guide the product gas in such a way that, in said state, it does not come into contact with the inner wall of the outlet connection or come other solid wall in the vicinity of the tubular zone. Simultaneously measures must be taken to cool the product gas in the tubular zone to such an extent that the entrained particles have lost their tackiness at the outlet end. This is brought about by the represented apparatus.

Within the outlet connection 2 is provided an annular insert 3 which, between itself and the inner wall of the outlet connection 2, forms a gap 4. At the upper end of gap 4, one or more inlet ports 5 for a cooling gas are equidistantly spaced over the circumference of outlet connection 2, and simultaneously serve to form a gas wall preventing contact between the product gas and the inner wall of the outlet connection 2 or insert 3. The inlet port or ports 5 can e.g. be connected to a ring main passed round the outlet connection 2.

The cooling gas flowing down through gap 4 prevents the product gas from entering the latter and consequently the blockage of said gap by the particles contained in the product gas. Simultaneously, the upwardly flowing product gas deflects the cooling gas around the lower end of insert 3, so that on the inner face of insert 3 it again flows upwards parallel thereto. It thereby forms a continuous gas wall, which prevents contact between the product gas and insert 3. The tacky particles entrained in the product gas can consequently not reach the inner wall of insert 3, so that they cannot become attached thereto. During its passage through insert 3, the cooling gas also brings about a cooling of the product gas, so that at the upper outlet of insert 3 the product gas has cooled to such an extent that the particles therein have lost their tackiness.

This cooling action is aided by the fact that the insert 3 is also cooled. The insert has, for example, in its interior cooling channels, through which flow water or some other suitable cooling medium.

What is claimed is:

1. Apparatus for cooling a flowing hot product gas containing tacky particles which lose their tackiness on cooling, comprising:

an outer wall of a means emitting said hot product gas containing tacky particles having a longitudinal axis, an upstream portion which converges in the direction of the flow of the hot product gas and a tubular portion which intersects said upstream portion and has a longitudinal axis, the hot product gas flowing into said tubular portion from said converging portion with said converging portion turning the flow of hot product gas radially inwardly of the tubular portion toward said tubular portion longitudinal axis;

an annular tubular insert wall positioned within said outer wall tubular portion and being spaced therefrom to define an annular gap between said tubular insert wall and said outer wall tubular portion, said annular gap extending axially of said insert wall, said tubular insert wall having an upstream end and a downstream end, with said upstream end being located adjacent to the intersection of said outer wall tubular portion and said converging portion;

a cooling gas inlet port in said outer wall tubular portion for guiding cooling gas into said annular gap, said inlet port being located nearer to said tubular insert wall downstream end then to said upstream end so that cooling gas flowing into said annular gap from said inlet port flows upstream of the hot product gas flow direction;

said tubular insert wall upstream end defining with said outer wall a cooling gas outlet port, said cooling gas outlet port opening into the hot product gas and being oriented to direct cooling gas upstream into the flowing hot product gas;

the configuration of the insert wall upstream end and its position with respect to the upstream portion of the means emitting the hot product gas being arranged to cause said cooling gas to flow in said annular gap and to contact said annular tubular insert wall and to flow into the hot product gas adjacent to the cooling gas outlet port at an angle to the flow direction of hot product gas flowing past said outlet port, said cooling gas being turned radially inward and then back into the flow direction of the hot product gas to flow around said insert wall upstream end and back along said tubular insert wall to be positioned between the hot product gas and said insert wall for essentially the entire length of said insert wall whereby cooling gas defines a film which prevents the tacky particles from contacting said insert wall and cools the hot product gas and said insert wall.

2. The apparatus defined in claim 1 in which said cooling gas flowing in said annular gap contacts said tubular insert wall to cool same.

3. The apparatus defined in claim 2 further including cooling channels defined in said annular insert wall.

4. The apparatus defined in claim 1 wherein said tubular insert wall upstream end is located upstream of the intersection between said tubular portion and said converging portion with respect to the direction of hot product gas flow.

5. The apparatus defined in claim 1 wherein said tubular insert wall upstream end is curved.

6. The apparatus defined in claim 1 in which said annular gap extends for essentially the entire length of said tubular insert wall.

7. The apparatus defined in claim 1 wherein said outer wall converging portion is arcuate.

8. The apparatus defined in claim 1 in which said annular tubular insert wall and said tubular portion are coaxial.

9. The apparatus defined in claim 3 in which said cooling channels contain a liquid.

* * * * *